United States Patent [19]

Kane et al.

[11] 4,189,246

[45] Feb. 19, 1980

[54] VARIABLE PRINT-HAMMER CONTROL FOR ON-THE-FLY-PRINTING

[75] Inventors: Milburn H. Kane, Round Rock; Norman F. Barrow, Austin, both of Tex.

[73] Assignee: International Business Machines Corporation, Armonk, N.Y.

[21] Appl. No.: 863,450

[22] Filed: Dec. 22, 1977

[51] Int. Cl.[2] ..... B41J 1/30; B41J 9/38

[52] U.S. Cl. ..... 400/144.2; 101/93.03; 400/51; 400/157.3; 400/166

[58] Field of Search ..... 101/93.03, 93.15–93.19; 400/51, 52, 144.2, 144.3, 157.3, 166, 322, 328

[56] References Cited

U.S. PATENT DOCUMENTS

| | | | |
|---|---|---|---|
| 3,858,509 | 1/1975 | Grundherr | 400/144.2 X |
| 4,030,591 | 6/1977 | Martin et al. | 400/144.2 X |
| 4,058,195 | 11/1977 | Fravel et al. | 400/144.2 X |

*Primary Examiner*—Paul T. Sewell

*Attorney, Agent, or Firm*—Robert W. Turner; James H. Barksdale, Jr.

[57] ABSTRACT

A rotatable print disc is mounted on a carrier which traverses along the print line. The disk is moved from each character position to the next by the shortest distance and it is stopped at the time of printing. The carrier is moved from one print position to the next at a speed which is selected depending on the time required for the disk to rotate to the next character. Printing takes place with the carrier moving at one of a number of speeds. The force utilized to drive the hammer to print the characters is varied dependent on which character is being printed. Hammer firing for each character is timed dependent on printing speed and upon the force utilized to drive the hammer.

1 Claim, 8 Drawing Figures

DELAY TABLE
| CONDITION | DELAY TIME | HAMMER ENERGY PULSE |
|---|---|---|
| LV1<br>MV1<br>HV1 | D1<br>D2<br>D3 | P1<br>P2<br>P3 |
| LV2<br>MV2<br>HV2 | D4<br>D5<br>D6 | P1<br>P2<br>P3 |
| LV3<br>MV3<br>HV3 | D7<br>D8<br>D9 | P1<br>P2<br>P3 |
| LV4<br>MV4<br>HV4 | D10<br>D11<br>D12 | P1<br>P2<br>P3 |
FIG. 6
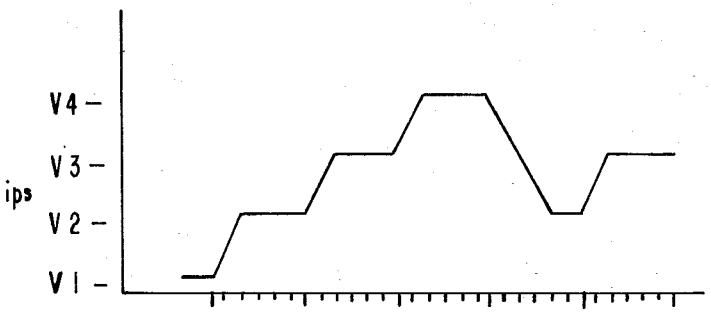
FIG. 4
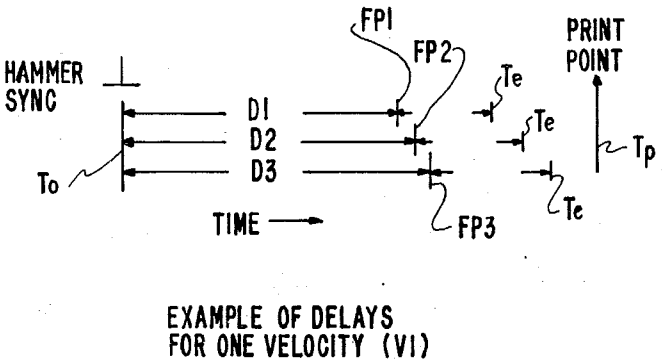
EXAMPLE OF DELAYS
FOR ONE VELOCITY (V1)
FIG. 5

VARIABLE PRINT-HAMMER CONTROL FOR ON-THE-FLY-PRINTING

BACKGROUND OF THE INVENTION

A. Field of the Invention

This invention relates to a movable disk printer and in one of its aspects to such a printer in which printing is provided while a movable carriage on which the movable disk is mounted and the movable disk is on the fly. In another aspect of this invention, it relates to such a printer in which the velocity of the carrier when moving between adjacent positions is variable, and the force applied to cause printing is varied according to the specific character being printed. In this respect this invention is a specific improvement upon the printing apparatus and methods disclosed in U.S. Pat. No. 4,030,591, assigned to the assignee of this invention, which disclosure is specifically incorporated herein by reference.

B. Description of the Prior Art

Printers which utilize a rotating disk with characters on the periphery thereof are well known. Several such printers are commercially available. Rotating disk printers can be divided in categories by either focusing on how the disk rotates or by focusing on how the carrier traverses.

Focusing on how the disk rotates, such printers can be divided into a first category where the disk constantly rotates and into a second category where the motion of the disk is intermittent. In printers with a constantly rotating disk, printing takes place when the hammer strikes the rotating disk. Rotation of the disk is not stopped each time a character is printed. In printers with a disk that intermittently rotates, the disk is rotated to the desired print position and then stopped. There is no disk rotation while printing takes place.

An alternate division of disk printers can be made by focusing upon the motion of the carrier. In some printers, the traverse of the carrier is stopped each time printing takes place. In other printers the carrier is moving at the instant when printing occurs. In both the type where the carrier is moving when printing occurs and in the type where the carrier is stopped when printing occurs, the disk may or may not be rotating at the time of printing. In some printers where the carrier is moving at a fixed speed when printing takes place, the carrier is slowed down and stopped between print positions in order to give the rotating disk time to move to the desired character.

In U.S. Pat. No. 4,030,591, a number of issued and pending patents are discussed which relate generally to printers of the type discussed above. As pointed out in this discussion, none of the references discussed show a printer where the carrier is moving at a plurality of different speeds when printing occurs and where the firing of the print hammer is timed dependent upon the speed of the carrier at the particular time. That specific feature, which permits increased printing speed, is found in U.S. Pat. No. 4,030,591, and is also one of the feature of this invention. However, the apparatus in that patent does not incorporate apparatus for varying the striking force of the hammer which is necessary in order to achieve high print quality.

In U.S. Pat. No. 3,858,509, issued to Willy J. Grundherr, a rotating disk printing apparatus is disclosed in which the striking force applied to the hammer can be varied between "light" and "hard". However, in that patent the printing is not done on the fly and there is no need to coordinate the speed of the carriage and the travel time of the print hammer to insure that the position of the character to be printed is at the print impact point at the time it is caused to strike the printing medium.

SUMMARY OF THE INVENTION

Generally stated, it is an object of this invention to provide a printer, such as illustrated in U.S. Pat. No. 4,030,591, but with improved print quality and improved performance.

Another object is to provide an improved method of printing utilizing such a printing apparatus.

More specifically, it is an object of this invention to provide for controlling the speed of the carrier in accordance with the time required to position the print wheel at the desired position, while also controlling the printing impact force.

Another object of this invention is to control the speed of the carrier and to control the hammer flight time in response to the carrier speed and the force applied to the printing hammer.

Another object of this invention is to control carrier speed and the printing impact force in such a way that high quality proportionally-spaced printing can be done with a high throughput speed.

The present invention provides a start-stop disk printer which has one motor for controlling the disk and another motor for controlling the carrier movement. As in all mechanical systems, the mechanical characteristics of these motors and other related mechanical components impose physical limitations such as maximum speeds, maximum accelerations and maximum decelerations. The present invention is directed to maximizing the performance of the printer by controlling the carrier traverse, disk rotation, and hammer firing such that the maximum capacities of the motors and other physical components can be utilized more fully than possible to the prior art control schemes. In addition, the impact force of the hammer causing printing can be varied, and the hammer firing time coordinated to provide improved printing quality while maintaining relatively high through-put speed.

The novel control mechanism of this invention moves the carrier at several different speeds depending upon the particular sequence of characters being printed. Also the striking force of the hammer may be varied depending on the character to be printed. The particular time the print hammer is fired is varied depending upon the speed of the carrier when the particular character is printed and the striking force applied to the hammer.

The foregoing and other objects, features and advantages of the invention will be apparent from the more particular description of a preferred embodiment of the invention as illustrated in the accompanying drawing.

BRIEF DESCRIPTION OF THE DRAWINGS

Referring now to the drawings, wherein a preferred embodiment of this invention is illustrated, and wherein like reference numerals are used throughout to designate like parts;

FIG. 4 is a graph showing the various velocities utilized to move the carrier a certain distance in order to provide an example of carriage movement during printing;

FIG. 5 is a diagram illustrating the duration of certain delay periods and the print hammer control pulse widths utilized in this invention to control the printing hammer;

FIG. 6 is a chart showing the relationship between the various delays and pulse widths employed to obtain a desired printing impact force and a desired escapement velocity of the printing carriage;

DESCRIPTION OF THE PREFERRED EMBODIMENT

Figure 1:
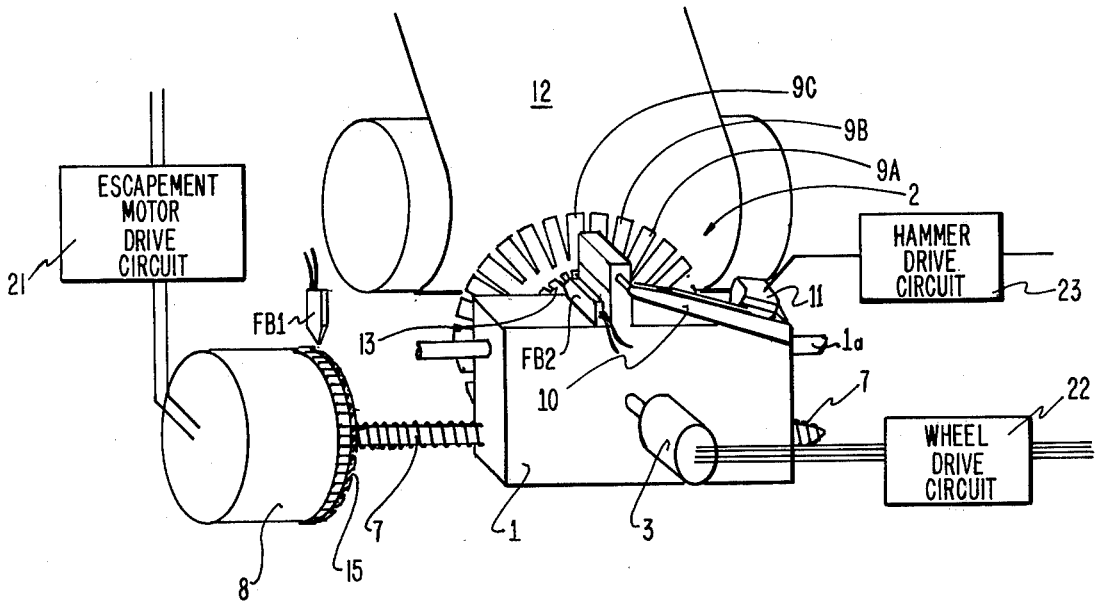
FIG. 1 shows a printer apparatus adapted for use with the present invention.

FIG. 1 shows the main mechanical components of the present printer. They are shown somewhat schematically since such components are well known and the present invention is directed to the control mechanism for the two stepper motors 3 and 8 and the print hammer 10, and not to the mechanical components per se.

As shown in FIG. 1, a laterally sliding carrier 1 is mounted on a guide rod 1*a* and a lead screw 7 and carries a rotatable print wheel or disc 2 driven by a stepping motor 3. The carrier 1 is driven by lead screw 7 which is driven by a stepping motor 8. Alternatively, motor 8 could drive a belt which in turn could drive carrier 1.

A type disc 2 comprises a disk having a number of movable type elements such as the flexible spokes or type fingers 9A, 9B, 9C, etc. Printing of any desired character is brought about by operating a print hammer 10, which is actuated by a solenoid 11, both of which are mounted on carrier 1. When the appropriate type finger approaches the print position, solenoid 11 actuates hammer 10 into contact with the selected type finger, driving it into contact with a paper 12 or other printing medium. An emitter wheel 13 attached to and rotating with type disc 2 cooperates with a magnetic sensor FB2 to produce a stream of emitter index pulses for controlling the operation of the printer. The emitter has a series of teeth each of which correspond to one finger 9A, 9B, 9C, etc. A homing pulse is generated for each revolution of the print wheel by a single tooth on another emitter (not shown). The printer controls can thus determine the angular position of type disc 2 at any time by counting the pulses received since the last homing pulse. A toothed emitter 15 is mounted on the shaft of the motor 8 and in conjunction with a transducer FB1 provides pulses which indicate the position of the carrier 1.

Stepper motors 3 and 8 are activated by conventional drive circuits 21 and 22. Examples of the type of drive circuitry that could be used are shown in U.S. Pat. No. 3,636,429. A hammer solenoid 11 is actuated by a hammer drive circuit 23 which is also conventional.

The actions of positioning the carrier 1 and positioning the print wheel 2 are, in general, independent except that coordination is required at the instant printing occurs. Both type disc 2 and carrier 1 must be in a selected position (but they need not be at rest) when hammer 10 strikes type disc 2.

Figure 2:
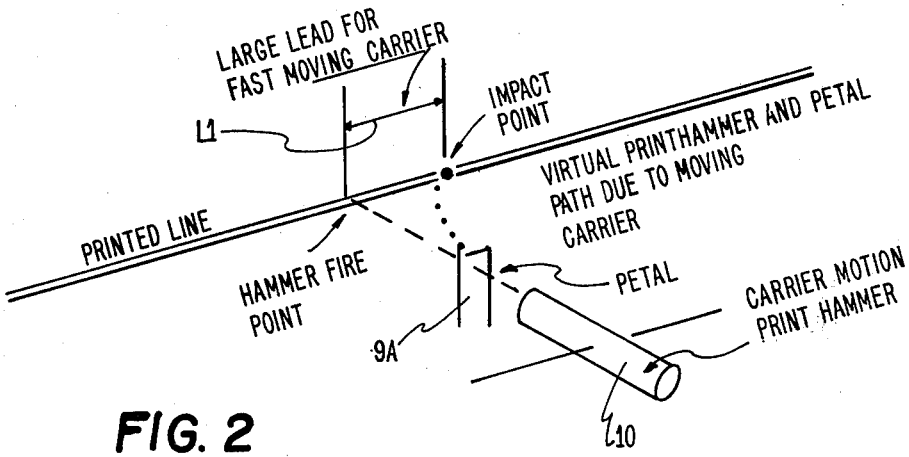
FIG. 2 is a diagrammatic view illustrating the relationship between the hammer firing point and the impact point when the carrier is moving at a relatively fast rate.
Figure 3:
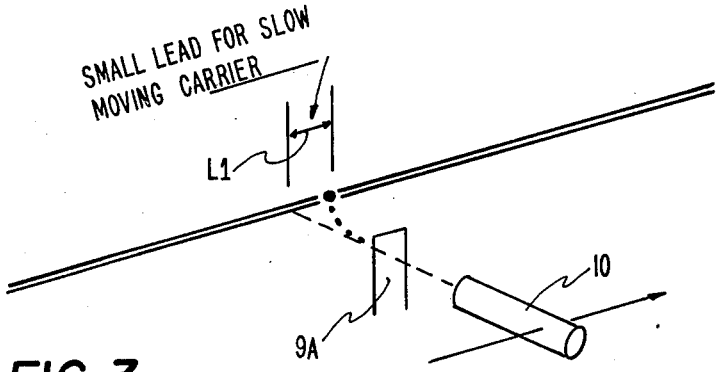
FIG. 3 is a view similar to FIG. 2 except that that carrier is moving at a relatively slow rate.

Referring now to FIGS. 2 and 3, the relationship between the hammer firing point (at which time the firing of the print hammer is initiated), and the impact point on the printed line is illustrated. In the instance of FIG. 2, this relationship is illustrated when carrier 1 is moved at a relatively high velocity, whereas in FIG. 3 the same relationship is illustrated except that the carrier is being moved at a slower velocity. As illustrated in FIG. 2, a relatively large lead indicated by the arrow L1 is required for petal 9*a* to imprint on the printed line at the impact point, whereas in FIG. 3 the line L1 is relatively shorter. Thus, it is apparent that when the velocity of the carrier is changed that either the hammer firing point must be changed if the flight time of the print hammer is constant, or the hammer flight time must be also varied so that petal drive will impact the printing medium at the desired print point.

As set out in U.S. Pat. No. 4,030,591, the motion of the carrier can be chosen to move at a plurality of different velocities depending upon the character selection of the print wheel and, thus, the time required for the print wheel to move between adjacent characters. In that patent, four different velocities are utilized for the carriage and for purposes of illustrating this invention, the movement of carriage 1 will likewise be at a velocity chosen among four separate velocities, V1, V2, V3, and V4. For purposes of illustration of this invention, it is assumed that velocity V1 will be the slower of the velocities, velocity V2 faster than V1, velocity V3 faster than V2 and V1, and velocity V4 the fastest velocity. Thus, by selecting the fastest velocity at which the carrier can move for any selected change in position of print wheel 2 as it moves between successive characters (or spaces if such are in the sequence of characters to be printed), then the printing speed of the printer can be maximized. Thus, an important feature of the present invention is to provide for actuation of the print hammer in coordination with the selected carrier velocity in order to insure that when different carrier velocities are selected, the print hammer will be fired at the appropriate time in order to permit the printing petal to strike the printing medium at the desired impact point.

As previously noted, a further important feature of the present invention is the provision for variation in the striking force of the print hammer on the selected print wheel petal, in accordance with character selection, in order to improve the print quality of the apparatus. However, since variations in the striking force cause variations in the flight time of the petal from the point of impact by the hammer to the impact point to the printed line, it is further necessary to coordinate with the carriage velocity and hammer firing point with flight time of the petal for each different flight times (or striking forces) which may be selected.

In the case where the force causing print hammer 10 to strike the petal is constant, such as disclosed in U.S. Pat. No. 4,030,591, then it is only necessary to coordinate the firing point of the hammer with information concerning the carrier velocity in order to insure that the correct impact point will be struck under different character velocities. However, as set out herein, the impact force on the print hammer is a function of the width of the firing pulse, so that the width of this pulse can be varied to vary the flight time of the print hammer and petal. Thus, in use of this invention it is also necessary to coordinate this flight time information, or pulse width, with information concerning the carrier velocity and the time of initiation of the hammer firing sequence.

These relationships can be best understood by referring to FIGS. 4, 5, and 6. FIG. 4 illustrates a typical example of the excursion of carrier 1 at the four different velocities, V1, V2, V3, and V4, over a certain distance, which, in this instance, is approximately ½'. In accordance with this invention, it is also desired to provide a plurality of firing pulse widths for the actuation of the print hammer such as pulse widths of the durations of P1, P2, and P3, as illustrated in FIG. 5. Further, in order to insure that when the hammer is fired by one of the three pulses of different widths (each respectively representing a different striking force) and when the carriage is moving one of the four different velocities, an appropriate delay is provided after initiation of the print hammer actuation cycle and until actual firing of the print hammer. Thus, for any combination of one of the four velocities of the carrier, and one of the three pulse widths for the firing pulse for the hammer, the impact or print point will always fall at the desired location. In FIG. 5 an example is given of the different delays that must be provided from the time that a hammer sync pulse is initiated at time $t_o$ to initiation of the hammer firing pulse FP1, FP2, or FP3 in order to provide printing at the time tp as illustrated. Three separate delay times D1, D2, and D3 are illustrated, and, in this example, since the carriage velocity is the same (V1), then the variations in the delay times of D1, D2 and D3 is dependent upon the width of each of the pulses P1, P2 and P3. In an example given, it is assumed that pulse P1 is of the shortest duration, pulse P2 of a duration longer than pulse P1, and pulse P3 of a duration longer than pulses P1 and P2, and each are respectively initiated at the firing times FP1, FP2, and FP3. Each of the pulses respectively terminates at some time te prior to print point time tp. Since pulse P3 drives print hammer 10 the hardest, the flight time of the hammer from time FP3 to TP is the shortest as is the time from the end of the pulse, te, to print point time tp. The flight time of the hammer when actuated by pulse P2 is correspondingly longer than that required for pulse P3, and the flight time of the print hammer when actuated by pulse P1 is the longest for the three pulse durations indicated. Thus, because of these different flight times, it is necessary in order to coordinate the print time of the pedal being struck by the print hammer, to provide an appropriate delay time for each of the different striking forces that can be chosen for the print hammer and for each of the different velocities that can be chosen for carrier 1.

FIG. 6 illustrates a delay table which lists the different delay times that can be chosen for appropriate combination of chosen carrier motion velocity and print hammer striking force. As illustrated in FIG. 6, each of the hammer energy pulses P1, P2 and P3 can correspond to either light impact, medium impact, or hard impact, respectively, of the print hammer. Thus, for each of the four velocities of the carrier, V1, V2, V3 and V4, one of the three impact conditions, light, medium, or hard (as represented by pulses P1, P2 or P3) can be chosen. Since this means twelve velocity-print impact combinations are possible in the example given in FIG. 6, it is necessary to provide for twelve separate delay times D1 through D12 to coordinate the firing time and flight time of the print hammer with the velocity of the carrier. Thus, in the example illustrated in this invention, a suitable microprocessor utilized to control the motion of the carrier and the motion of the print wheel, and the actuation of the print hammer, can be programmed to provide an appropriate delay time D1 to D12 upon receipt of the hammer sync signal and upon receipt of information as to velocity of the carrier and the duration of the firing pulse chose.

Figure 7:
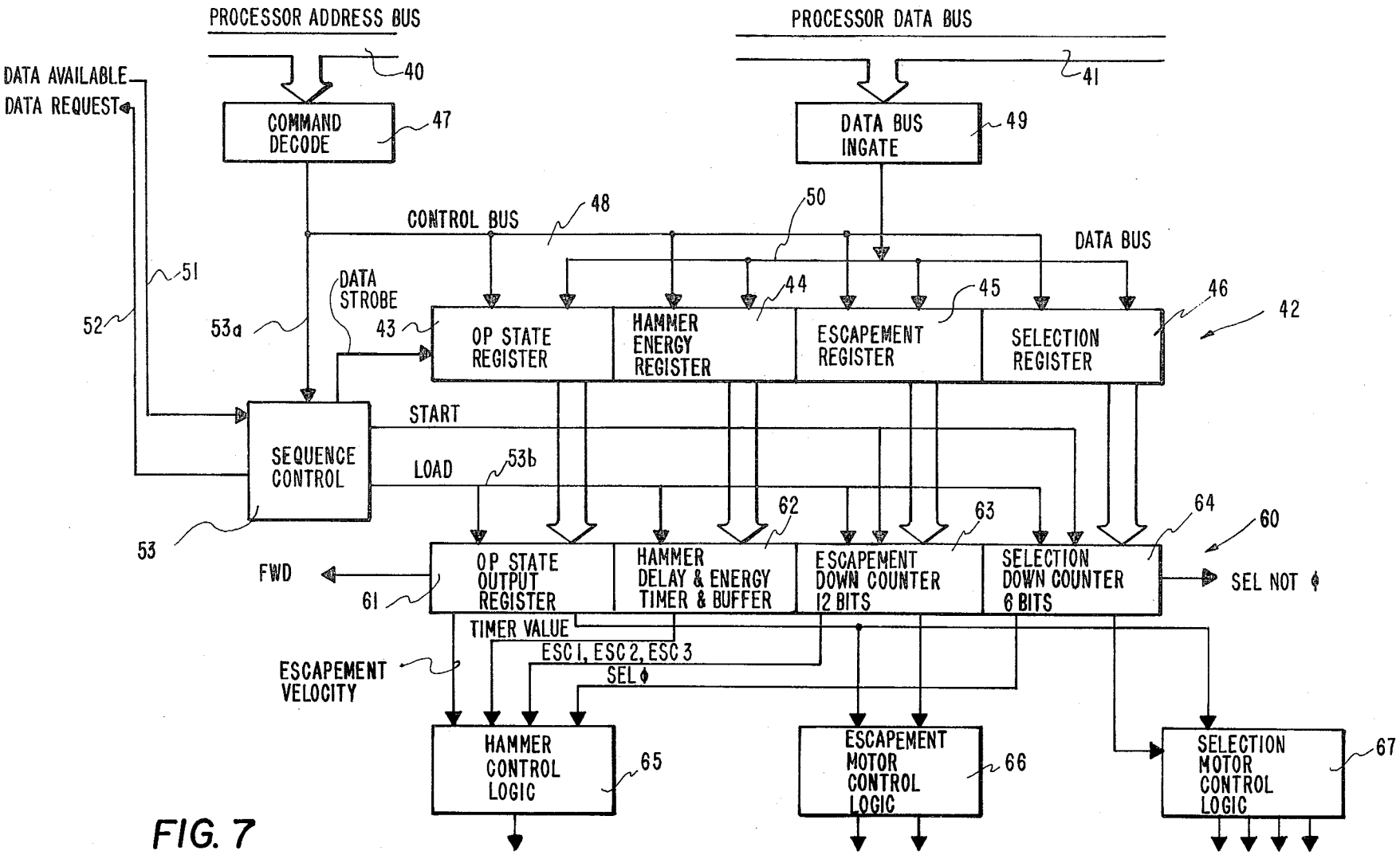
FIG. 7 is a schematic diagram, in block form, of the circuitry for controlling the operation of the motors moving the carriage and the printing disc, and of the circuitry controlling the firing of the print hammer.

Referring now to FIG. 7, a schematic diagram is illustrated of circuitry which may be utilized employing the principles of this invention discussed above in order to provide the appropriate control signals to drive circuit 21 (also referred herein as escapement motor drive circuit), to drive print wheel circuit 22, and to the hammer drive circuit 23. The data which is to be printed comes from a data source (not shown), which may be a conventional data buffer or keyboard input device such as a typewriter. Data from the data source is conducted to the input of a suitable computer or microprocessor, only the output of which is illustrated in FIG. 7, and the microprocessor can be any suitable commercially available microprocessor or computer such as the IBM system/7. The microprocessor receives the input data and will make certain calculations and then sends a series of binary numbers out on either an address bus 40 or a data bus 41 as illustrated in FIG. 7. In response to the data received from the microprocessor, the circuitry shown in FIG. 7 generates appropriate drive pulses to circuits 21, 22, and 23 in order to cause stepper motors 3 and 8 to move the carrier and the disc to the correct positions, and to activate the print hammer 10 in order to print the data supplied by the data source. The input signals to each of the drive circuits 21 and 22 include information indicating the direction which the stepper motor should move, and the number of steps to be moved, it being understood that one pulse is provided by the appropriate drive circuit for each step of the motors 3 and 8.

As illustrated in FIG. 7, the circuitry of this invention includes a plurality of buffer registers indicated generally by the reference numeral 42 which receive appropriate information from the microprocessor through address bus 40 and data bus 41. As illustrated in FIG. 7, buffer registers 42 include an operating state register 43, which controls the velocity of movement of carrier 1, a hammer energy register 44 which stores data concerning initiation time and duration of the hammer energy pulse and the delay times D1 to D12, an escapement register 45 which receives and stores data concerning the extent of movement of carrier 1, and a selection register 46 which receives and stores data from the microprocessor concerning the selection of the characters on the printing wheel 2. In order to load data into the buffer registers 42 from the microprocessors, address data from the microprocessor bus 40 in inputted into a command decode circuit 47 and from there through a control bus 48 to the respective buffer registers. Likewise, data from data bus 41 of the microprocessor is routed through a data bus in gate 49 and data bus 50 to the respective inputs of the buffer registers 42. The microprocessor is also connected through the control bus 48, a data available line 51, and a data request line 52 to a sequence control circuit 53 which controls the sequence of operation of the circuitry of FIG. 7 and of the microprocessor, as hereinafter explained. Since printing is accomplished by the present invention while carrier 1 is in motion, it is necessary to provide buffer registers 42 in order that data from the processor may be stored therein prior to actual usage, to permit the processor to accumulate subsequent data and to permit new data to be stored in the buffer registers when the previously stored data has been dumped. In this manner, the data is available to the operating registers in circuitry FIG. 7 described below when needed in order to permit the continuous operation of the system.

In addition to the buffering registers described, the circuit of FIG. 7 also includes a plurality of operating registers, illustrated generally by the reference numeral 60. In general, upon receipt of appropriate load command, operating registers 60 receive and store the information contained in the buffer registers 42, thus permitting the buffer registers to then intake new data while the data in the operating registers is being acted on. As illustrated in FIG. 7, an operating state output register 61 is provided to receive and store data from operating state register 43, a hammer delay and energy register 62 is provided to receive stored data received from hammer energy register 44, an escapement down counter is provided to receive and store data from escapement register 45, and a selection down counter 64 is provided to receive and store data from a selection register 46. The outputs of the respective registers are connected as shown in FIG. 7 to hammer control logic 65 for controlling the actuation of print hammer 10, to escapement control motor logic 66 for controlling the motion of carrier 1, and to selection motor control logic 67 for controlling the motion of print wheel 2.

In operation of the apparatus illustrated in FIG. 7, a control signal 53*a* from the microprocessor is conducted to sequence control circuit 53 and will cause sequence control circuit to start the sequence of operation of the printing apparatus of the invention. As each series of data from the microprocessor is acted on, sequence control circuit 53 will advise the microprocessor through line 52 that buffer registers 42 are ready to review the next bank of data. The data available response of the microprocessor on line 51 initiates a control sequence whereby a data strobe signal from sequence control circuit 53 arms the buffer registers 42 for receipt of new data from the microprocessor. The appropriate register is addressed by the microprocessor through control bus 48 and when the proper address is received by the individual registers, the data for that register is conducted through ingate 49 and data bus 50 to be stored in the register. Once this is accomplished, the sequence control circuit 53 provides a load control signal on line 53*b* which is conducted from sequence control 53 to each of the operating registers 60 to permit the data stored in buffer registers 42 to be dumped into the operating registers 60. Once this is accomplished, sequence control signal 53 will then request new data of the processor which would then function to provide the next series of the data to be stored in buffer registers 42. Of course, while this is being done, the data in operating registers can be acted on.

Figure 8:
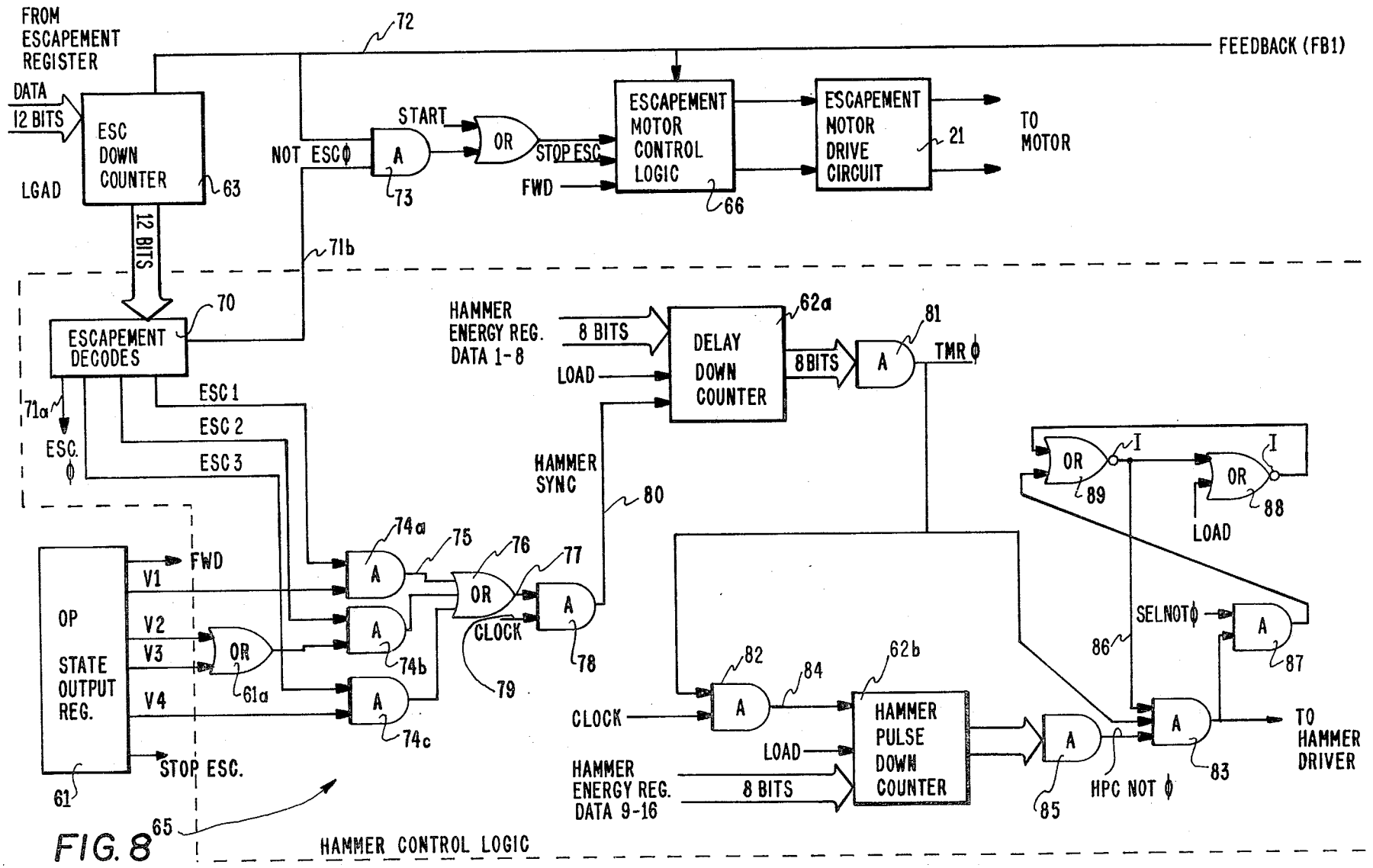
FIG. 8 is a more detailed schematic diagram, in block form, of the circuitry for controlling the firing of the print hammer and the escapement of the carriage.

With the exception of the selection control logic, details of the logic control for the escapement motor and hammer driver are illustrated in FIG. 8. As illustrated therein, the escapement data stored in register 63 is conducted in a sequence of 12 bits to escapement decode circuit 70 which provides three output signals ESC1, ESC2 and ESC3. These signals represent the number of units of movement that the carrier is away from escapement zero, with ESC1 being equal to one unit from zero, ESC2 being two units from zero, and ESC3 being three units from zero. The information from which these signals are derived can come from sensor FB1 through input line 72 and each unit can be any predetermined number of pulses from sensor FB1. Also, decode circuit 70 provides a fourth output at line 71*a* indicating that the escapement movement has reached zero point, and a fifth output which is indicated by line 71*b* and on which a signal is present when escapement has not reached zero. Thus, as long as line 71*b* is high and a signal is received on line 72 from position indicator FB1, then an AND circuit 73 will provide an output to escapement motor control logic 66 to provide for movement of the motor. This movement will continue as long as no escapement zero signal on line 71*b* is high.

Since velocity V1 is the slow velocity of movement of carriage 1, the output signal ESC1 from escapement decode 70, which represents an escapement position one unit from zero, can be combined in an AND circuit 74*a* with velocity signal V1 from operating state output register 61, so that when the velocity of the escapement motor is at V1, and one unit from zero ESC1 has been reached, an output is provided on line 75 and conducted to OR circuit 76 which in turn provides an output 77 to an AND circuit 78 which is under control of a clock pulse on line 79. In similar fashion, escapement unit ESC2 can be combined in an AND circuit 74*b* with signals from operating state output register 61 representing escapement velocities of either V2 or V3, (determined by OR circuit 61*a*) and escapement unit signal ESC3 can be combined in AND circuit 74*c* with escapement velocity signal V4. Thus, when any conditions are present which indicate that the carrier has arrived at one, two, or three units from zero in the escapement movement, at one of the velocities V1 to V4, AND gate 78 which is armed by clock signal 79 will provide a hammer sync pulse on line 80. This is the same pulse that is indicated by $t_0$ in FIG. 5 and is used to actuate the delay down counter 62*a* which has been previously loaded with data indicating the delay time required for the period of time from the hammer sync pulse to initiation of the firing pulse (FP1, FP2, or FP3). As indicated previously, with respect to the charts shown in FIG. 6, the information stored in the delay down counter 62*a* can be delay number from 1 to 12 indicating one of twelve possible delay periods, and this number is contained in eight bits of data received. Thus, as counter 62*a* counts down to zero, an output is provided through a circuit 81 (indicated as TMR0 or time zero) and this output is conducted to the input of an AND circuit 82 and a second AND circuit 83 as illustrated in FIG. 8. AND circuit 82 is also armed by a clock pulse, and receipt of the signal TMR0 from a circuit 81 will provide an output on line 84 which is conducted to the input of hammer pulse down counter 62*b* which determines the duration of the energy signal or pulse utilized to drive the hammer to actuation. As indicated, counter 62*b* has previously been loaded with information from register 44 contained in 8 bits concerning whether or not the pulse width is to be one of three pulses, P1, P2, or P3, as previously noted with respect to the discussion of FIGS. 5 and 6. The output of counter 62*b* is inverted so that as long as the counter is still counting, and its output has not reached zero, a signal is provided by AND gate 85 (referred to as HPC not 0) and this output is conducted to AND gate 83. Thus, as long as a pulse is provided to energize the print hammer as indicated by counter 62*b* being not zero, and the delay time has timed out as indicated by the output TMR0 from AND gate 81, then AND gate 83 is armed with these two signals. However, AND gate 83 requires a third input signal in order for the hammer to be actuated and it receives such on line 86. The absence of a signal on line 86 inhibits the firing of a hammer. Thus, by use of the inhibit circuit illustrated in the event that a petal has not been selected (such as a space movement of the carriage) then the hammer will be inhibited from striking the petal until it receives the next command that a petal has been selected. Once a signal (Sel. Not 0) has been received by an AND gate 87, in combination with a load signal on OR gate 88 (forming, with OR gate 89, a latch circuit), the latch will be effective to permit actuation of the hammer driver.

A start signal may be provided from sequence control circuit 53 to initiate the operation of the apparatus disclosed in FIGS. 7 and 8. However, once the sequence of operation is started and the various mechanical devices incorporated in the printer are in motion, the start pulse is ignored. Also, in the sequence of events utilized with the preferred embodiment of this invention disclosed, when escapement motor 8 reaches the zero position (indicated by the ESCO signal from escapement decode 70), this is the signal that the carrier is at the impact point and impact should have occurred. At this point the operating registers are ready to be reloaded and the mechanical system of the printer is ready to be moved to the next adjacent position.

While the present invention has been illustrated by providing for the selection of three printing impact forces, i.e., light, medium, and hard, and four different escapement velocities, V1 to V4, it is to be understood that more or less of these parameters can be chosen and to do so is within the scope of this invention.

Also, other embodiments of this invention are also possible so long as they provide for the necessary coordination between the velocity of movement of the carrier and the hammer flight time as set out in the description of this invention.

The method described allows Miniprocessor control of the printhammer voltage pulse over a wide range of starting points and pulse width. Only software changes are required to make alteration anywhere in the range. Other advantages of this invention are:

1. The amount of logic is minimized because pulse parameters are stored in the miniprocessor memory instead of being decoded in hardware.

2. Ease of pulse parameter control through software changes. This is significant because it allows for:

a. Machine development changes.

b. Use of different printhammer designs.

c. Changes of printer carriage speeds, or use of different printers.

d. Changes of print ribbon or erase tape impact requirements.

e. Development of abnormal control for diagnostic purposes.

3. Pulse width tolerances are tightly controlled by the use of clocking that can be derived from the Miniprocessor system clock.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

We claim:

1. A printer for printing at a plurality of print positions along a printing line on a document, comprising, in combination;

a carrier;

means for moving said carrier at a plurality of different velocities along said print line past said print positions in response to an escapement control signal;

a rotatable type element mounted on said carrier, and having characters thereon;

means for rotating said type element in response to a type selector signal;

a print hammer mounted on said carrier and operable to impact said type element when a selected one of said characters is positioned at a print position at which said selected one of said characters is to be printed;

means for actuating said print hammer in response to a hammer firing pulse;

a plurality of buffer registers adapted to receive and store data indicative of the values of said escapement control signal, said type selector signal, and said hammer firing pulse, and to receive and store data concerning the time of initiation and duration of said hammer firing pulse;

a plurality of operating registers for receiving and storing data from said buffer registers;

a selection control logic circuit for receiving said data indicative of the value of said type selector signal from said operating registers to provide said type selector signal;

an escapement control logic circuit for receiving data in said operating registers indicative of the value of said escapement control signal to provide said escapement control signal to cause said moving means to move said carrier at one of said plurality of different velocities; and a hammer control logic circuit for receiving data in said operating registers concerning initiation time and duration of said hammer firing pulse to provide said hammer firing pulse at the correct point in time during movement of said carrier and for one of a plurality of different durations to cause said hammer to impact said type element, said duration of said hammer firing pulse being dependent upon said type selector signal, and said initiation time being dependent upon said duration and said escapement control signal.

* * * * *